US010753185B2

(12) United States Patent
Flowers et al.

(10) Patent No.: US 10,753,185 B2
(45) Date of Patent: Aug. 25, 2020

(54) WELLBORE PLUNGERS WITH NON-METALLIC TUBING-CONTACTING SURFACES AND WELLS INCLUDING THE WELLBORE PLUNGERS

(71) Applicants: Daniel R. Flowers, Neuquen (AR); Anthony J. Bermea, Midland, TX (US); Michael C. Romer, The Woodlands, TX (US)

(72) Inventors: Daniel R. Flowers, Neuquen (AR); Anthony J. Bermea, Midland, TX (US); Michael C. Romer, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 149 days.

(21) Appl. No.: 16/031,615

(22) Filed: Jul. 10, 2018

(65) Prior Publication Data

US 2019/0100982 A1 Apr. 4, 2019

Related U.S. Application Data

(60) Provisional application No. 62/588,728, filed on Nov. 20, 2017, provisional application No. 62/568,109, filed on Oct. 4, 2017.

(51) Int. Cl.
*E21B 43/12* (2006.01)
*E21B 17/00* (2006.01)
(Continued)

(52) U.S. Cl.
CPC ..... *E21B 43/121* (2013.01); *E21B 17/00* (2013.01); *E21B 41/02* (2013.01); *E21B 47/00* (2013.01); *F04B 47/12* (2013.01)

(58) Field of Classification Search
CPC ..... E21B 43/121; E21B 17/00; E21B 41/02; E21B 47/00; F04B 47/12
See application file for complete search history.

(56) References Cited

U.S. PATENT DOCUMENTS 2,878,754 A * 3/1959 McMurry ..... F04B 47/12 417/60
2,893,493 A * 7/1959 Copas ..... E21B 37/045 166/170
(Continued)

FOREIGN PATENT DOCUMENTS

EP 2 077 374 A1 7/2009
GB 2 393 747 A 4/2004
(Continued)

OTHER PUBLICATIONS

Walker, Julian (2014) "*Use of plastic coated tubing in artificial lift applications*", URL: https://www.slideshare.net/thorneandderrick1985/pipeline-oil-gas-magazine-october-2014-featuring-thorne-derrick, pp. 1-7 (XP055507618).

*Primary Examiner* — Michael R Wills, III
(74) *Attorney, Agent, or Firm* — ExxonMobil Upstream Research Company—Law Department

(57) ABSTRACT

Wellbore plungers with non-metallic tubing-contacting surfaces and wells including the wellbore plungers. The wellbore plungers are configured to be utilized within a tubing conduit of the downhole tubing. The downhole tubing includes a non-metallic tubing material that defines a non-metallic tubing surface. The non-metallic tubing surface at least partially defines the tubing conduit. The wellbore plungers include an uphole region, which defines an uphole bumper-contacting surface, a downhole region, which defines a downhole bumper-contacting surface, and a plunger body. The plunger body extends between the uphole region and the downhole region and defines a downhole
(Continued)

tubing-contacting surface. The downhole tubing-contacting surface is configured for sliding contact with the non-metallic tubing surface, defines a sealing structure configured to form an at least partial fluid seal with the downhole tubing, and is at least partially defined by a non-metallic tubing-contacting material.

23 Claims, 2 Drawing Sheets

(51) Int. Cl.

| | |
|---|---|
| ***E21B 41/02*** | (2006.01) |
| ***E21B 47/00*** | (2012.01) |
| ***F04B 47/12*** | (2006.01) |

(56) References Cited

U.S. PATENT DOCUMENTS

| | | | | |
|---|---|---|---|---|
| 3,020,852 | A * | 2/1962 | Roach | E21B 43/127 417/513 |
| 6,148,923 | A * | 11/2000 | Casey | E21B 43/121 166/329 |
| 6,328,102 | B1 | 12/2001 | Dean | |
| 7,111,675 | B2 | 9/2006 | Zisk, Jr. | |
| 7,117,947 | B2 * | 10/2006 | Wilson | E21B 27/02 166/372 |
| 7,322,803 | B2 * | 1/2008 | Vogeley | F04B 9/105 417/413.2 |
| 7,484,940 | B2 | 2/2009 | O'Neill | |
| 7,597,150 | B2 | 10/2009 | Clem | |
| 7,870,899 | B2 * | 1/2011 | Wilson | E21B 43/12 166/105 |
| 8,133,041 | B2 | 3/2012 | Ludlow et al. | |
| 8,220,533 | B2 | 7/2012 | Longfield et al. | |
| 8,316,950 | B2 * | 11/2012 | Rodriguez | E21B 43/121 166/369 |
| 8,511,390 | B2 | 8/2013 | Coyle et al. | |
| 2002/0197174 | A1 | 12/2002 | Howard | |
| 2003/0010491 | A1 | 1/2003 | Collette | |
| 2005/0178543 | A1 | 8/2005 | Giacomino | |
| 2006/0090893 | A1 | 5/2006 | Sheffield | |
| 2006/0198742 | A1 | 9/2006 | DiFoggio et al. | |
| 2007/0158061 | A1 * | 7/2007 | Casey | E21B 43/121 166/68 |
| 2008/0080991 | A1 | 4/2008 | Yuratich | |
| 2008/0185141 | A1 * | 8/2008 | Amies | E21B 43/121 166/105 |
| 2008/0283236 | A1 * | 11/2008 | Akers | E21B 43/121 166/105 |
| 2009/0183879 | A1 | 7/2009 | Cox | |
| 2009/0218091 | A1 | 9/2009 | Dotson | |
| 2010/0012313 | A1 | 1/2010 | Longfield | |
| 2012/0263606 | A1 * | 10/2012 | Bouldin | E21B 43/128 417/54 |
| 2013/0192685 | A1 | 8/2013 | Davis et al. | |
| 2015/0275633 | A1 | 10/2015 | Tolman et al. | |
| 2016/0319620 | A1 * | 11/2016 | Farrow | E21B 37/00 |
| 2017/0044883 | A1 | 2/2017 | Wilkinson | |
| 2017/0183946 | A1 * | 6/2017 | Tolman | E21B 47/065 |
| 2017/0356276 | A1 * | 12/2017 | Nelson | E21B 43/121 |

FOREIGN PATENT DOCUMENTS

| | | |
|---|---|---|
| GB | 2 403 752 A | 1/2005 |
| WO | WO 01/20126 A2 | 3/2001 |
| WO | WO 2009/077714 | 6/2009 |
| WO | WO 2011/079218 A2 | 6/2011 |

* cited by examiner

WELLBORE PLUNGERS WITH NON-METALLIC TUBING-CONTACTING SURFACES AND WELLS INCLUDING THE WELLBORE PLUNGERS

CROSS REFERENCE TO RELATED APPLICATIONS

This application claims the benefit of U.S. Provisional Application No. 62/588,728, filed Nov. 20, 2017 and U.S. Provisional Application No. 62/568,109, filed Oct. 4, 2017, the disclosure of which are incorporated herein by reference in their entireties.

FIELD OF THE DISCLOSURE

The present disclosure relates generally to wellbore plungers and more specifically to wellbore plungers with non-metallic tubing-contacting surfaces and/or to wells that include the wellbore plungers.

BACKGROUND OF THE DISCLOSURE

Wells may include downhole tubing that defines a tubing conduit and extends within a wellbore. Wellbore plungers may be conveyed within the tubing conduit, such as to provide artificial lift for the well, to clean the tubing conduit, and/or to remove corrosion and/or deposits from a region of the downhole tubing that defines the tubing conduit.

Downhole tubing generally is metallic and conventional wellbore plungers generally are metallic and have cylindrical forms. In some applications, fluids present within the wellbore may corrode metallic downhole tubing, which may result in fluid leaks and/or in loss of integrity of the metallic downhole tubing. To mitigate this issue, internal plastic coated (IPC) downhole tubing has been utilized. IPC downhole tubing includes a metallic tube that is internally coated with a layer of polymer, or plastic. The presence of the coating decreases a potential for corrosion of the IPC downhole tubing, thereby increasing a service life of a well that includes the IPC downhole tubing and/or decreasing a need for, or a frequency of, workovers that might be utilized to repair and/or replace corroded downhole tubing.

While IPC downhole tubing may be more resistant to corrosion when compared to metallic downhole tubing that does not include the internal polymer coating, conventional wellbore plungers may wear and/or damage the internal polymer coating, thereby decreasing a service life of the IPC downhole tubing. Because of this fact, wellbore operations that utilize conventional wellbore plungers, such as artificial lift operations and/or cleaning operations, may not be performed, or may be performed with limited frequency, in IPC downhole tubing.

It may be desirable to perform artificial lift and/or cleaning operations in wells that include IPC downhole tubing and/or to perform such operations at frequencies that are incompatible with conventional wellbore plungers due to coating wear and/or damage effects. Thus, there exists a need for wellbore plungers with non-metallic tubing-contacting surfaces and/or for wells that include the wellbore plungers.

SUMMARY OF THE DISCLOSURE

Wellbore plungers with non-metallic tubing-contacting surfaces and wells including the wellbore plungers. The wellbore plungers are configured to be utilized within a tubing conduit of the downhole tubing. The downhole tubing includes a non-metallic tubing material that defines a non-metallic tubing surface. The non-metallic tubing surface at least partially defines the tubing conduit. The wellbore plungers include an uphole region, a downhole region, and a plunger body. The uphole region defines an uphole bumper-contacting surface, and the downhole region defines a downhole bumper-contacting surface and is configured to engage with a bottom bumper of the well. The plunger body extends between the uphole region and the downhole region, may be an elongate plunger body, and defines a downhole tubing-contacting surface. The downhole tubing-contacting surface is configured for sliding contact with the non-metallic tubing surface when the wellbore plunger is utilized within the tubing conduit. The downhole tubing-contacting surface defines a sealing structure configured to form an at least partial fluid seal with the downhole tubing during sliding contact between the wellbore plunger and the non-metallic tubing surface. The downhole tubing-contacting surface is at least partially defined by a non-metallic tubing-contacting material.

The wells include a wellbore, downhole tubing extending within the wellbore, and the bottom bumper. The downhole tubing includes the non-metallic tubing material, which defines the non-metallic tubing surface that at least partially defines the tubing conduit. The bottom bumper is positioned proximate a downhole end of the tubing conduit. The well also includes the wellbore plunger, which is positioned within the tubing conduit during operative use of the wellbore plunger.

DETAILED DESCRIPTION AND BEST MODE OF THE DISCLOSURE

Figure 1:
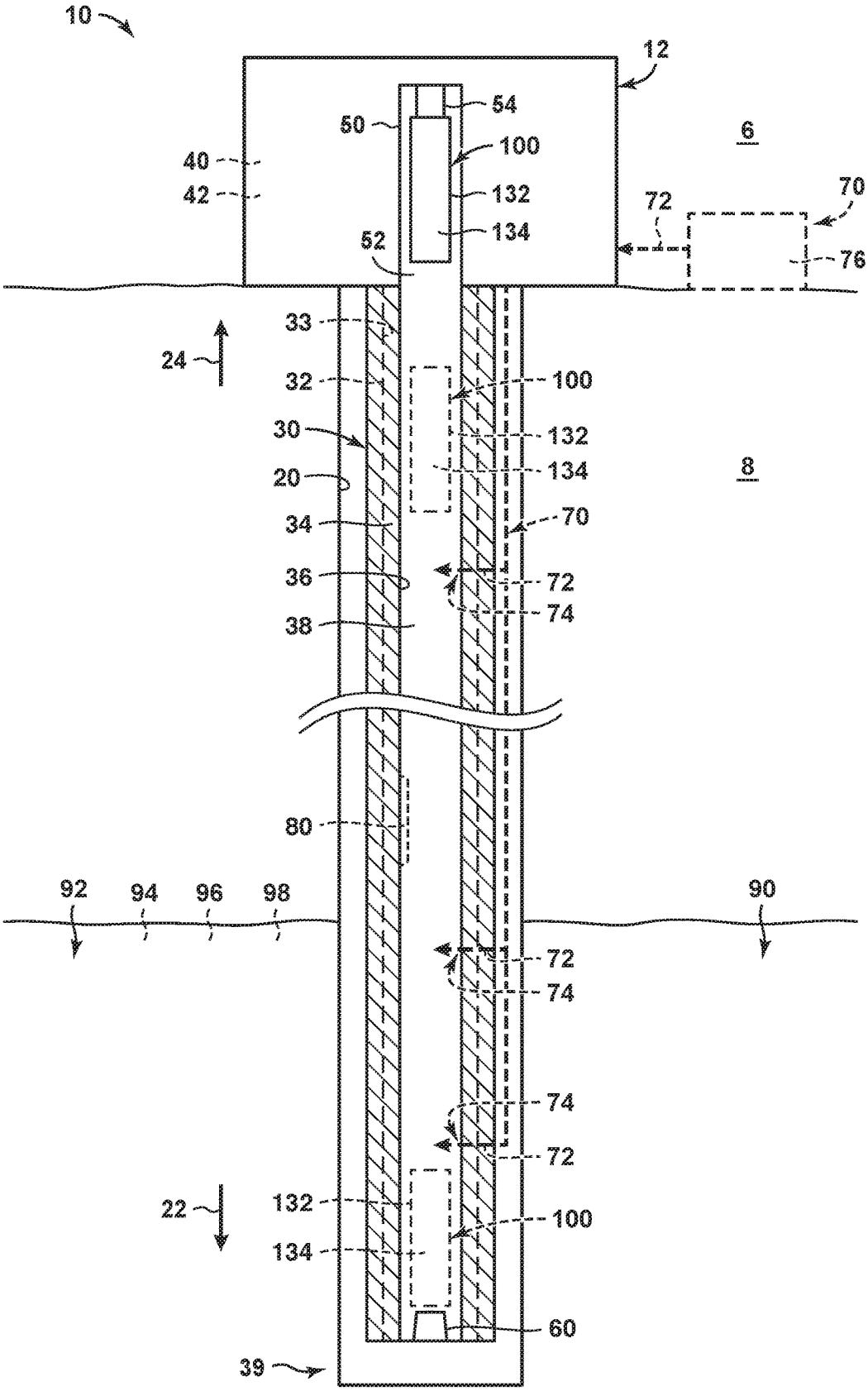
FIG. 1 is a schematic cross-sectional view illustrating examples of wells that may include and/or utilize wellbore plungers according to the present disclosure.
Figure 2:
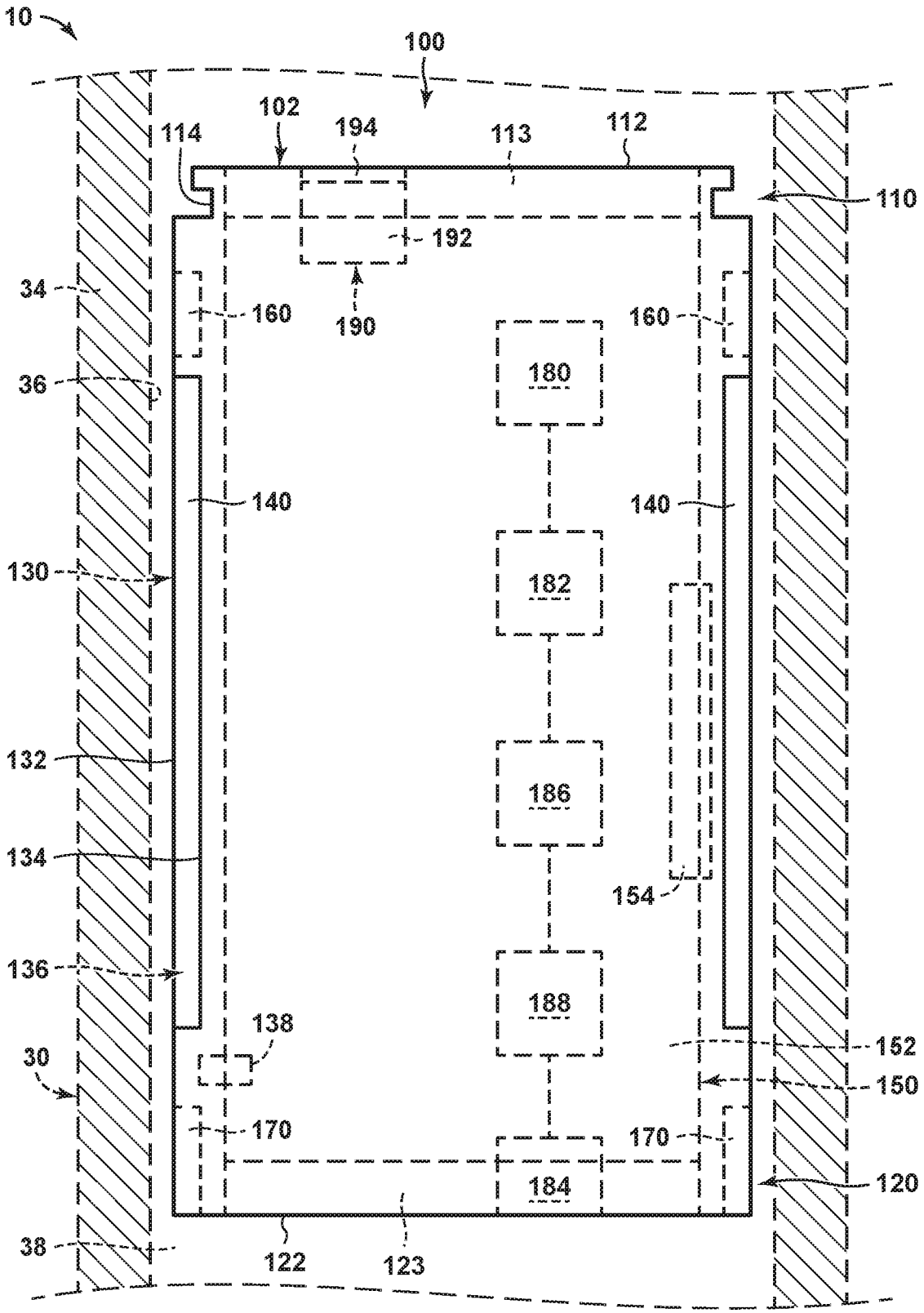
FIG. 2 is a schematic illustration of wellbore plungers according to the present disclosure.

FIGS. 1-2 provide examples of wellbore plungers 100 and/or of wells 10 that include and/or utilize wellbore plungers 100, according to the present disclosure. Elements that serve a similar, or at least substantially similar, purpose are labeled with like numbers in FIGS. 1-2, and these elements may not be discussed in detail herein with reference to each of FIGS. 1-2. Similarly, all elements may not be labeled in each of FIGS. 1-2, but reference numerals associated therewith may be utilized herein for consistency. Elements, components, and/or features that are discussed herein with reference to one or more of FIGS. 1-2 may be included in and/or utilized with any of FIGS. 1-2 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic cross-sectional view illustrating examples of wells 10 that may include and/or utilize wellbore plungers 100, according to the present disclosure. FIG. 2 is a schematic illustration of wellbore plungers 100 according to the present disclosure. Wellbore plungers 100 of FIG. 2 may include and/or be more detailed illustrations of wellbore plungers 100 of FIG. 1. Stated another way, FIG. 2 may illustrate a portion, or region, of well 10 of FIG. 1 that includes wellbore plungers 100. As such, any of the structures, functions, and/or features that are disclosed herein with reference to wellbore plungers 100 of FIG. 2 may be included in and/or utilized with wellbore plungers 100 and/or well 10 of FIG. 1 without departing from the scope of the present disclosure. Similarly, any of the structures, functions, and/or features that are disclosed herein with reference to wellbore plungers 100 and/or wells 10 of FIG. 1 may be included in and/or utilized with wellbore plungers 100 of FIG. 2 without departing from the scope of the present disclosure.

As perhaps best illustrated in FIG. 1, wells 10 include a wellbore 20 that extends within a subterranean formation 90. Wellbore 20 also may be referred to herein as extending within a subsurface region 8 and/or as extending between a surface region 6 and subsurface region 8 and/or a subterranean formation 90. Subterranean formation 90 may include a hydrocarbon 92, such as a liquid hydrocarbon 94 and/or a gaseous hydrocarbon 96. Subterranean formation 90 additionally or alternatively may include one or more other fluids 98, such as water.

Wells 10 also include downhole tubing 30. Downhole tubing 30 extends within wellbore 20 and includes a non-metallic tubing material 34. Non-metallic tubing material 34 defines at least a non-metallic tubing surface 36 of the downhole tubing, and non-metallic tubing surface 36 at least partially, or even completely, defines, or bounds, a tubing conduit 38.

Wells 10 further include a bottom bumper 60 and a wellbore plunger 100 and may include a wellhead 12 that includes a lubricator 50. Bottom bumper 60 is positioned proximate a downhole end 39 of tubing conduit 38. Lubricator 50 may be positioned within surface region 6 and/or may be in fluid communication with an uphole end of tubing conduit 38. In addition, lubricator 50 may define a plunger-receiving region 52, which is configured to receive and/or to retain wellbore plunger 100, and may include a lubricator bumper 54 that may be positioned within the plunger-receiving region.

Wellbore plunger 100 may be positioned within lubricator 50, as illustrated in solid lines in FIG. 1, or within tubing conduit 38, as illustrated in dashed and in dash-dot lines. For example, wellbore plunger 100 may be positioned within lubricator 50 when the wellbore plunger is not actively being utilized to provide artificial lift or other treatment to the tubing conduit, and the wellbore plunger may be positioned within the tubing conduit to provide such operative use within the conduit. As discussed in more detail herein with reference to FIG. 2, wellbore plunger 100 has and/or defines a downhole tubing-contacting surface 132 that is at least substantially defined by a non-metallic tubing-contacting material 134.

During operation of wells 10, wellbore plunger 100 repeatedly may be conveyed across at least a fraction of a length of tubing conduit 38. As an example, wellbore plunger 100 repeatedly may be conveyed between lubricator 50 and bottom bumper 60, such as to provide artificial lift to well 10 and/or to remove residue, scale, and/or corrosion (collectively schematically illustrated at 80 in FIG. 1) from non-metallic tubing surface 36 of downhole tubing 30.

As discussed, conventional wellbore plungers generally are metallic, with the downhole tubing-contacting surface or conventional wellbore plunger having a hardness that is greater than the hardness of the non-metallic tubing material that forms the non-metallic tubing surface of the downhole tubing. As such, contact between the conventional metallic plunger and non-metallic tubing surface 36 may generate unacceptable wear of and/or damage to the non-metallic tubing surface. In contrast, and as discussed herein, wellbore plungers 100, according to the present disclosure, include non-metallic tubing-contacting material 134 that at least substantially defines downhole tubing-contacting surface 132. As also discussed in more detail herein, non-metallic tubing-contacting material 134 may be softer than non-metallic tubing material 34 that defines non-metallic tubing surface 36 and/or may be configured to wear faster than, or to wear sacrificially relative to, the non-metallic tubing material. Stated another way, wellbore plungers 100, which are disclosed herein, may be configured to repeatedly be conveyed across the fraction of the length of tubing conduit 38 without damaging, without appreciably damaging, and/or with less than a threshold amount of wear to, non-metallic tubing material 34 and/or non-metallic tubing surface 36 that is defined thereby.

It is within the scope of the present disclosure that wellbore plunger 100 repeatedly may be conveyed within tubing conduit 38 in any suitable manner. As an example, well 10 may include and/or be an injection well configured to inject a pressurizing fluid stream into subterranean formation 90, such as to pressurize the subterranean formation. Under these conditions, wellbore plunger 100 may be conveyed in a downhole direction 22 within tubing conduit 38 under the influence of gravity and/or with and/or in the pressurizing fluid stream. Well 10 then may be backflowed, thereby conveying wellbore plunger 100 in an uphole direction 24 within tubing conduit 38.

As another example, well 10 may include a hydrocarbon production well, such as an oil well configured to produce liquid hydrocarbon 94 from the subterranean formation and/or a gas well configured to produce gaseous hydrocarbon 96 from the subterranean formation. Under these conditions, wellbore plunger 100 may be conveyed in downhole direction 22 within tubing conduit 38 under the influence of gravity and/or via shutting in well 10. Well 10 then could be allowed to produce, thereby conveying wellbore plunger 100 in uphole direction 24.

As discussed, wellbore plunger 100 may be utilized to provide artificial lift to well 10. As an example, subterranean formation 90 may include both gaseous hydrocarbon 96 and a liquid, such as liquid hydrocarbon 94 and/or fluid 98. Under these conditions, gaseous hydrocarbon 96 may flow to surface region 6 via tubing conduit 38 and liquid may build up within a downhole region of the tubing conduit. As a volume of liquid within the tubing conduit increases, a hydrostatic pressure exerted by this build-up of liquid may increase such that flow of the gaseous hydrocarbon into the tubing conduit is restricted and/or occluded, and wellbore plunger 100 may be utilized to remove this build-up of liquid.

More specifically, and as illustrated in dash-dot lines in FIG. 1, wellbore plunger 100 may be positioned proximate and/or in contact with bottom bumper 60 such that the liquid builds up above, or on an uphole end of, the wellbore plunger. Presence of the wellbore plunger may restrict flow of gaseous hydrocarbons 96 into tubing conduit 38, thereby causing a pressure within the subterranean formation to increase. Additionally or alternatively, the well may be shut in to restrict gas production and increase pressure within the subterranean formation.

Eventually, the pressure within the subterranean formation may be sufficient to convey the wellbore plunger, together with a volume, or slug, of liquid that extends thereabove, to the surface region, as illustrated in dashed lines in FIG. 1. This may occur passively, such as when the well is not shut in and the pressure within the subterranean formation naturally increases, thereby conveying the plunger to the surface. This also may occur actively, such as when the well is shut in, the pressure is allowed to increase, and the well subsequently is allowed to produce, thereby flowing pressurized fluids, and the wellbore plunger, from the wellbore via the tubing conduit.

When wellbore plungers 100 are utilized for artificial lift, and as illustrated in dashed lines in FIG. 1, wells 10 may include a gas injection system 70. Gas injection system 70, when present, may be configured to selectively inject a plurality of gas streams 72 into tubing conduit 38 at a plurality of spaced-apart gas injection points 74. The injection of gas streams 72 may increase pressure in a region of tubing conduit 38 that is downhole from wellbore plunger 100, thereby facilitating flow and/or motion of the wellbore plunger in uphole direction 24 within the tubing conduit. As also illustrated in dashed lines in FIG. 1, gas injection system 70 may include a gas source 76, which may be configured to produce and/or generate gas streams 72. Gas source 76 may be positioned within surface region 6 and/or proximate wellhead 12.

As discussed in more detail herein with reference to FIG. 2, wellbore plunger 100 may include a battery 182 and/or a transmitter 188. As illustrated in dashed lines in FIG. 1, wells 10 further may include a battery charger 40, which may be configured to charge battery 182 of wellbore plunger 100, such as when the wellbore plunger is positioned within plunger-receiving region 52 of lubricator 50. Additionally or alternatively, wells 10 may include a receiver 42, which may be configured to receive a data signal from wellbore plunger 100 and/or from transmitter 188 thereof.

As discussed, downhole tubing 30 includes non-metallic tubing material 34 that defines non-metallic tubing surface 36. It is within the scope of the present disclosure that downhole tubing 30 may be entirely, or at least substantially entirely, defined by non-metallic tubing material 34. Stated another way, downhole tubing 30, or at least a transverse cross-section thereof, may include and/or be a monolithic, or unitary, structure that is entirely defined by non-metallic tubing material 34.

Alternatively, it is also within the scope of the present disclosure that downhole tubing 30 may include one or more other materials in addition to non-metallic tubing material 34. As an example, downhole tubing 30 may include a metallic tubular 32 that has and/or defines a metallic inner surface 33. Under these conditions, non-metallic tubing material 34 may coat, cover, and/or encapsulate at least non-metallic inner surface 33 to form and/or define non-metallic tubing surface 36. State another way, non-metallic tubing material 34 may extend between metallic inner surface 33 and tubing conduit 38, thereby restricting, blocking, and/or occluding fluid contact between metallic tubular 32 and fluids that are present and/or conveyed within tubing conduit 38.

When non-metallic tubing material 34 coats, covers, and/or encapsulates metallic inner surface 33 of metallic tubular 32, the non-metallic tubing material may have and/or define any suitable thickness, or average thickness. Such a thickness, or average thickness, may be measured and/or defined, at any given location along metallic inner surface 33, in a direction that is normal to the metallic inner surface. Examples of the thickness, or of the average thickness, of non-metallic tubing material 34 include thicknesses of at least 0.05 millimeters (mm), at least 0.1 mm, at least 0.25 mm, at least 0.5 mm, at least 0.75 mm, at least 1 mm, at least 2 mm, at least 3 mm, at least 4 mm, at most 5 mm, at most 4 mm, at most 3 mm, at most 2 mm, and/or at most 1 mm.

Turning now to FIG. 2, more specific and/or detailed examples of wellbore plungers 100, according to the present disclosure, are shown. As illustrated in FIG. 2, wellbore plungers 100 include an uphole region 110 and a downhole region 120. Uphole region 110 defines an uphole bumper-contacting surface 112, which may be configured to engage with and/or to contact lubricator bumper 54 of FIG. 1. Downhole region 120 defines a downhole bumper-contacting surface 122, which may be configured to engage with and/or to contact bottom bumper 60 of FIG. 1.

Wellbore plungers 100 also include a plunger body 130, which may be an elongate plunger body 130. The plunger body extends between uphole region 110 and downhole region 120, and defines downhole tubing-contacting surface 132. As used herein, the phrase "downhole tubing-contacting surface" may refer to any portion of an outer, of an external, and/or of an exposed, surface 102 of wellbore plunger 100 that contacts, or that is configured to contact, non-metallic tubing surface 36 of downhole tubing 30 when the wellbore plunger is positioned and/or conveyed within tubing conduit 38. Exposed surface 102 may include any surface that bounds and/or defines wellbore plunger 100. Stated another way, exposed surface 102 may include any surface of wellbore plunger 100 that would be wetted when the wellbore plunger is immersed within a fluid.

The downhole tubing-contacting surface includes an entirety of the surface, or surface area, of wellbore plunger 100 that contacts, or that is configured to contact, non-metallic tubing surface 36 when the wellbore plunger is utilized within well 10. However, the downhole tubing-contacting surface does not necessarily include, or is not required to include, portion(s) of the exposed surface of the wellbore plunger that do not, or that cannot, contact non-metallic tubing surface 36 when the wellbore plunger is utilized within well 10. As an example, downhole tubing-contacting surface 132 may not include uphole bumper-contacting surface 112 and/or downhole bumper-contacting surface 122. However, downhole tubing-contacting surface 132 generally will include a majority, or even an entirety, of exposed surface 102 of plunger body 130 that extends between uphole region 110 and downhole region 120 and/or between uphole bumper-contacting surface 112 and downhole bumper-contacting surface 122.

Wellbore plunger 100, plunger body 130, and/or downhole tubing-contacting surface 132 thereof may be configured for sliding contact with non-metallic tubing surface 36 of downhole tubing 30 when the wellbore plunger is utilized within the downhole tubing. Stated another way, as discussed herein, wellbore plunger 100 may be conveyed along the length of tubing conduit 38; and, while being conveyed along the length of the tubing conduit, may slide along and/or against non-metallic tubing surface 36.

Downhole tubing-contacting surface 132 defines a sealing structure 140. Sealing structure 140 may be configured to form and/or define a fluid seal, or an at least partial fluid seal, with downhole tubing 30 and/or with non-metallic tubing surface 36 thereof, during sliding contact between the wellbore plunger and the non-metallic tubing surface.

In contrast with conventional metallic wellbore plungers, wellbore plungers 100, according to the present disclosure, include a non-metallic tubing-contacting material 134 that at least substantially defines downhole tubing-contacting surface 132. State another way, non-metallic tubing-contacting material 134 may define a majority, or even an entirety, of downhole tubing-contacting surface 132. Stated yet another way, downhole tubing-contacting surface 132 may consist of, or may consist essentially of, non-metallic tubing-contacting material 134.

As discussed herein, non-metallic tubing-contacting material 134 may be softer than non-metallic tubing material 34. Thus, wellbore plungers 100 may not produce and/or generate wear of non-metallic tubing surface 36 during sliding contact therewith and/or may produce significantly less wear during the sliding contact when compared to conventional metallic wellbore plungers.

It is within the scope of the present disclosure that non-metallic tubing-contacting material 134 may form and/or define any suitable portion, fraction, and/or region of wellbore plunger 100. As an example, non-metallic tubing-contacting material 134 may form and/or define an entirety of exposed surface 102 of wellbore plunger 100. Under these conditions, the non-metallic tubing-contacting material may form and/or define uphole bumper-contacting surface 112 and/or downhole bumper-contacting surface 122.

As another example, non-metallic tubing-contacting material 134 may form and/or define downhole tubing-contacting surface 132 but may not form and/or define at least a portion, or region of exposed surface 102. Stated another way, non-metallic tubing-contacting material 134 may form and/or define less than an entirety of exposed surface 102. Stated yet another way, exposed surface 102 may be formed and/or defined by a plurality of distinct materials. Stated another way, a material composition of the exposed surface may vary systematically along a length, or across regions, of the wellbore plunger (e.g., among the uphole bumper-contacting surface, the downhole bumper-contacting surface, and the downhole tubing-contacting surface).

As a more specific example, uphole bumper-contacting surface 112 may be formed and/or defined by an uphole bumper-contacting surface material 113 that differs from the non-metallic tubing-contacting material. As another more specific example, downhole bumper-contacting surface 122 may be formed and/or defined by a downhole bumper-contacting surface material 123 that differs from the non-metallic tubing-contacting material. The uphole bumper-contacting surface material may be the same as, or different from, the downhole bumper-contacting surface material.

As yet another more specific example, the uphole bumper-contacting surface material and/or the downhole bumper-contacting surface material may be metallic. As another more specific example, the uphole bumper-contacting surface material may have an uphole bumper-contacting surface material hardness that is greater than a non-metallic tubing-contacting material hardness of the non-metallic tubing-contacting material. As yet another example, the downhole bumper-contacting surface material may have a downhole bumper-contacting surface material hardness that is greater than the non-metallic tubing-contacting material hardness.

The non-metallic tubing-contacting material hardness, the uphole bumper-contacting surface material hardness, and/or the downhole bumper-contacting surface material hardness may be measured, defined, and/or quantified in any suitable manner, an example of which is a Shore hardness and/or a Shore hardness test. In addition, the uphole bumper-contacting surface material hardness and/or the downhole bumper-contacting surface material hardness may differ from the non-metallic tubing-contacting material hardness by any suitable amount. As examples, the uphole bumper-contacting surface material hardness and/or the downhole bumper-contacting surface material hardness may be at least a threshold multiple of the non-metallic tubing-contacting material hardness. Examples of the threshold multiple include 2, 5, 10, 20, 50, 75, 100, 250, 500, and/or 1,000.

It is within the scope of the present disclosure that wellbore plunger 100 may have any suitable internal composition. As an example, an entirety of the wellbore plunger may be formed and/or defined by non-metallic tubing-contacting material 134. As another example, wellbore plunger 100 may include and/or be a composite wellbore plunger that may include at least a core 150, which is defined by a core material 152, and a downhole tubing-contacting shell 136, which is defined by non-metallic tubing-contacting material 134. Under these conditions, core material 152 may form and/or define uphole bumper-contacting surface 112 and/or downhole bumper-contacting surface 122. Examples of core material 152 include a metal, a material that has a greater density than a density of non-metallic tubing-contacting material 134, and/or a material that has a greater hardness than the non-metallic tubing-contacting material hardness.

When wellbore plunger 100 includes core 150 and downhole tubing-contacting shell 136, the downhole tubing-contacting shell and/or the non-metallic tubing-contacting material thereof may have and/or define any suitable thickness, or average thickness. The thickness, or average thickness, may be measured as a shortest distance between core 150 and downhole tubing-contacting surface 132 at any suitable point along the downhole tubing-contacting surface. Examples of the thickness, or average thickness, include thicknesses of at least 0.05 millimeters (mm), at least 0.1 mm, at least 0.25 mm, at least 0.5 mm, at least 0.75 mm, at least 1 mm, at least 2 mm, at least 3 mm, at least 4 mm, at most 5 mm, at most 4 mm, at most 3 mm, at most 2 mm, and/or at most 1 mm.

When wellbore plunger 100 includes core 150 and downhole tubing-contacting shell 136, the wellbore plunger may be formed and/or defined in any suitable manner. As an example, the downhole tubing-contacting shell may be molded, or injection molded, over and/or around the core. As another example, the downhole tubing-contacting shell may be applied to the core. Under these conditions, the downhole tubing-contacting shell also may be referred to herein as a downhole tubing-contacting coating. As yet another example, the downhole tubing-contacting shell may be separately formed and then operatively coupled to the core. Under these conditions, the downhole tubing-contacting shell also may be referred to herein as a downhole tubing-contacting body.

When wellbore plunger 100 includes core 150 and downhole tubing-contacting shell 136, core 150 may include at least one adhesion-enhancing region 154. Adhesion-enhancing region 154, when present, may be configured to resist separation of the non-metallic tubing-contacting material from the core and/or to enhance adhesion of the non-metallic tubing-contacting material to the core. Examples of adhesion-enhancing region 154 include a roughened region, a region of increased surface area, a reduced-diameter region, a cutout region, and/or one or more triangular cutouts that may be defined by core 150.

When wellbore plunger 100 includes core 150 and downhole tubing-contacting shell 136, the wellbore plunger further may include a retention structure 138. Retention structure 138, when present, may be configured to be selectively actuated between a retaining configuration, in which the retention structure operatively attaches the downhole tubing-contacting shell to the core, and a released orientation, in which the retention structure permits, or facilitates, separation of the downhole tubing-contacting shell from the core. Such a configuration may permit replacement of the downhole tubing-contacting shell and/or re-use of the core.

Non-metallic tubing-contacting material 134 may include and/or be any suitable material and/or materials. As examples, non-metallic tubing-contacting material may include one or more of a polymer, a phenolic resin, an epoxy, a polyether ether ketone, and/or a polyphenylene sulfide. As another example, the non-metallic tubing-contacting material may include a material that resists, or that is selected to resist, degradation, corrosion, and/or dissolution within a downhole environment of well 10 and/or of tubing conduit 38. This may include a material that resists, or that is selected to resist, temperatures, pressures, and/or chemistries that are present in the downhole environment. Examples of the temperatures include temperatures of at least 37° Celsius (° C.), at least 50° C., at least 75° C., at least 100° C., at least 150° C., at least 200° C., at least 250° C., or at least 300° C. Examples of the pressures include pressures of at least 5 kilopascals (kPa), at least 10 kPa, at least 15 kPa, at least 20 kPa, at least 30 kPa, at least 50 kPa, at least 75 kPa, and/or at least 100 kPa. Examples of the chemistries include chemistries that include hydrocarbons, liquid hydrocarbons, gaseous hydrocarbons, water, acids, and/or bases that naturally may be present within subterranean formation 90 and/or that may be injected into the subterranean formation during operation of hydrocarbon wells 10.

It is within the scope of the present disclosure that non-metallic tubing-contacting material 134 may be continuous, or at least substantially continuous, across downhole tubing-contacting surface 132. Additionally or alternatively, the non-metallic tubing-contacting material may be continuous, or at least substantially continuous, between uphole region 110 and downhole region 120 and/or between uphole bumper-contacting surface 112 and downhole bumper-contacting surface 122.

As discussed, downhole tubing-contacting surface 132 is configured for sliding contact with non-metallic tubing surface 36 when wellbore plunger 100 is utilized within tubing conduit 38 of well 10. As also discussed, wellbore plungers 100, which are disclosed herein, may be configured to produce much less wear of non-metallic tubing surface 36 when compared with conventional metallic wellbore plungers. To facilitate this low amount of wear, non-metallic tubing-contacting material 134 and/or downhole tubing-contacting surface 132 thereof may be smooth and/or non-galling to non-metallic tubing material 34.

Additionally or alternatively, non-metallic tubing-contacting material 134 may be selected to wear more quickly than non-metallic tubing material 34 during sliding contact therebetween and/or between downhole tubing-contacting surface 132 and non-metallic tubing surface 36. As examples, the non-metallic tubing material may wear at least 2, at least 3, at least 4, at least 5, at least 6, at least 8, at least 10, at least 15, at least 20, at least 30, at least 40, and/or at least 50 times more quickly than the non-metallic tubing material.

Additionally or alternatively, a non-metallic tubing material hardness of the non-metallic tubing material may be at least a threshold multiple of the non-metallic tubing-contacting material hardness. The hardness may be quantified and/or defined in any suitable manner, including those that are disclosed herein. Examples of the threshold multiple include threshold multiples of 2, 5, 10, 20, 50, 75, 100, 250, 500, and/or 1,000.

Non-metallic tubing-contacting material 134 additionally or alternatively may be configured as a sacrificial material during sliding contact between the wellbore plunger and the non-metallic tubing surface. As an example, the non-metallic tubing-contacting material may be configured to deposit on the non-metallic tubing surface, to reinforce the non-metallic tubing surface, and/or to fill defects and/or discontinuities in the non-metallic tubing surface.

As illustrated in dashed lines in FIG. 2, wellbore plungers 100 may include a detection structure 180. Detection structure 180, when present, may be configured to detect at least one property of downhole tubing 30 during sliding contact between the wellbore plunger and the non-metallic tubing surface. As an example, detection structure 180 may include a casing collar locator configured to detect casing collars of the downhole tubing and/or to determine a location of the wellbore plunger within the tubing conduit. As another example, detection structure 180 may include a thickness detector configured to detect a thickness of the downhole tubing, a thickness of the non-metallic tubing material, and/or a thickness of a non-metallic tubing coating that is defined by the non-metallic tubing material and that defines the non-metallic tubing surface. As yet another example, detection structure 180 may include a residue detector configured to detect buildup, or deposition, of residue on the non-metallic tubing surface.

When wellbore plungers 100 include detection structure 180, the wellbore plunger also may include a battery 182. Battery 182, when present, may be configured to power, or to provide electric power to, detection structure 180, such as to permit and/or facilitate operation of the detection structure. An example of battery 182 includes a rechargeable battery.

When wellbore plungers 100 include battery 182, the wellbore plungers also may include an energy harvesting structure 184. Energy harvesting structure 184, when present, may be configured to charge battery 182 while the wellbore plunger is within the tubing conduit and/or during sliding contact between the wellbore plunger and the non-metallic tubing surface. An example of energy harvesting structure 184 includes a turbine and generator assembly.

Wellbore plunger 100 also may include a data storage device 186. Data storage device 186, when present, may be configured to store the at least one property of the downhole tubing. This may include storage of an instantaneous value of the at least one property of the downhole tubing, storage of an average value of the at least one property of the downhole tubing, storing the at least one property of the downhole tubing as a function of time, and/or storing the at least one property of the downhole tubing as a function of location within the tubing conduit.

Wellbore plunger 100 further may include a transmitter 188. Transmitter 188, when present, may be configured to selectively transmit a data signal that is indicative of the at least one property of the downhole tubing. As an example, and as discussed herein with reference to FIG. 1, well 10 may include a receiver 42 configured to receive the data signal from transmitter 188.

It is within the scope of the present disclosure that well 10, wellbore plunger 100, and/or an operator of the well and/or of the wellbore plunger may utilize detection structure 180, including the at least one property of the downhole tubing, data storage device 186, and/or transmitter 188 in any suitable manner. As an example, transmitter 188 may be utilized to transmit the data signal to the operator, such as while the wellbore plunger is in the lubricator, and the operator may utilize the data signal, or the at least one property of the downhole tubing that is represented by the data signal, to control, to regulate, and/or to make decisions regarding operation of well 10. As another example, detection structure 180 may be utilized to identify corroded regions of downhole tubing 30, to identify holes in non-metallic tubing material 34, and/or to quantify wear of the non-metallic tubing material. As another example, detection structure 180 may be utilized to detect buildup of residue, or a rate of residue buildup, on non-metallic tubing surface 36. Under these conditions, a frequency at which the wellbore plunger is conveyed within the tubing conduit may be selected and/or regulated based, at least in part, on the residue buildup and/or on the rate of residue buildup.

As illustrated in dashed lines in FIG. 2, wellbore plungers 100 also may include a stored fluid reservoir 190. Stored fluid reservoir 190, when present, may be configured to store, and to selectively release a stored fluid 192. The selective release may be accomplished in any suitable manner. As an example, wellbore plungers 100 may include a release mechanism 194 that may be configured to be selectively transitioned from a closed state to an open state. In the closed state, the release mechanism may retain the stored fluid within the stored fluid reservoir, while in the open state, the release mechanism may permit the stored fluid to flow from the stored fluid reservoir and/or into the tubing conduit. Examples of release mechanism 194 include valve and a closure.

Stored fluid 192 may include any suitable fluid and may be selectively released based upon and/or responsive to any suitable criteria. As an example, the stored fluid may include a patching agent configured to reinforce the non-metallic tubing material. Under these conditions, the patching agent may be released from the stored fluid reservoir responsive to determining, such as via detection by detection structure 180, that the non-metallic tubing material is damaged and/or has less than a threshold thickness.

As additional examples, the stored fluid may include a residue-removing material, which may be configured to remove residue from the non-metallic tubing surface, a scale inhibitor, which may be configured to inhibit scale formation on the non-metallic tubing surface, a corrosion inhibitor, which may be configured to inhibit corrosion of the metallic tubular that may form a portion of downhole tubing 30, an asphaltenes inhibitor, which may be configured to inhibit asphaltenes deposition on the non-metallic tubing surface, and/or a paraffin inhibitor, which may be configured to inhibit paraffin deposition on the non-metallic tubing surface. Under these conditions, the stored fluid may be released from the stored fluid reservoir responsive to determining, such as via detection by detection structure 180, one or more of greater than a threshold amount of residue on the non-metallic tubing surface, greater than a threshold amount of scale on the non-metallic tubing surface, greater than a threshold amount of corrosion of the metallic tubular, greater than a threshold amount of asphaltenes deposition on the non-metallic tubing surface, and/or greater than a threshold amount of paraffin deposition on the non-metallic tubing surface.

As illustrated in FIG. 2, wellbore plunger 100 also may include a fishing neck 114. Fishing neck 114, when present, may be configured to be selectively and/or operatively engaged by a fishing tool, such as to permit and/or facilitate removal of the wellbore plunger from the tubing conduit should the wellbore plunger become stuck and/or lodged within the tubing conduit.

As illustrated in dashed lines in FIG. 2, wellbore plungers 100 also may include a scraping structure 160. Scraping structure 160, when present, may be defined by downhole tubing-contacting surface 132 and/or by non-metallic tubing-contacting material 134 and may be configured to remove, or to scrape, residue from the non-metallic tubing surface. This may include removal of the residue without damage to the non-metallic tubing surface. Examples of the scraping structure include a ridge and/or a helical ridge. Examples of the residue include scale, asphaltenes, and/or corrosion.

As illustrated in dashed lines in FIG. 1, wellbore plungers 100 also may include a rotation-inducing structure 170. Rotation-inducing structure 170, when present, may be defined by downhole tubing-contacting surface 132 and/or by non-metallic tubing-contacting material 134 and may be configured to induce rotation of the wellbore plunger, relative to the tubing conduit, while the wellbore plunger is conveyed within the tubing conduit and/or during sliding contact between the wellbore plunger and the non-metallic tubing surface. An example of rotation-inducting structure 170 includes a plurality of rotation-inducing ridges.

In addition to the structures discussed herein, wellbore plungers 100, according to the present disclosure, also may include one or more additional structures that may be common to conventional wellbore plungers that do not include non-metallic tubing-contacting material 134. As examples, wellbore plungers 100 may include structures that are conventional to, or may function as, a bypass plunger, a continuous flow plunger, a solid plunger, a spiral plunger, a sand plunger, a brush plunger, a pad plunger, and/or a smart plunger.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B and C, together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The wellbore plungers and wells disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A wellbore plunger configured to be utilized within a tubing conduit of downhole tubing, the tubing conduit including a non-metallic tubing material defining a non-metallic tubing surface that at least partially defines an interior surface within the tubing conduit, the wellbore plunger comprising:

an uphole region defining an uphole bumper-contacting surface;

a downhole region defining a downhole bumper-contacting surface configured to engage with a bottom bumper of a well; and a plunger body extending between the uphole region and the downhole region and defining a downhole tubing-contacting surface, wherein:

(i) the downhole tubing-contacting surface is configured for sliding contact with the non-metallic tubing surface when the wellbore plunger is utilized within the tubing conduit;

(ii) the downhole tubing-contacting surface defines a sealing structure configured to form an at least partial fluid seal with the downhole tubing during sliding contact between the wellbore plunger and the non-metallic tubing surface; and (iii) the downhole tubing-contacting surface is at least substantially defined by a non-metallic tubing-contacting material;

wherein the wellbore plunger is a composite wellbore plunger including at least a core, which is defined by a core material, and a downhole tubing-contacting shell, which is defined by the non-metallic tubing material.

2. The wellbore plunger of claim 1, wherein the wellbore plunger defines an exposed surface, and further wherein the non-metallic tubing material defines an entirety of the exposed surface.

3. The wellbore plunger of claim 1, wherein the wellbore plunger defines an exposed surface, and further wherein the non-metallic tubing material defines less than an entirety of the exposed surface.

4. The wellbore plunger of claim 1, wherein at least one of:

(i) the uphole bumper-contacting surface is defined by an uphole bumper-contacting surface material that differs from the non-metallic tubing-contacting material; and (ii) the downhole bumper-contacting surface is defined by a downhole bumper-contacting surface material that differs from the non-metallic tubing-contacting material.

5. The wellbore plunger of claim 1, wherein the core material at least one of:

(i) is metallic;
(ii) has a greater density than the non-metallic tubing-contacting material; and
(iii) has a greater hardness than the non-metallic tubing-contacting material.

6. The wellbore plunger of claim 1, wherein the core material defines at least one of:
(i) the uphole bumper-contacting surface; and
(ii) the downhole bumper-contacting surface.

7. The wellbore plunger of claim 1, wherein an average thickness of the non-metallic tubing-contacting material, as measured along a shortest distance between the core and the downhole tubing-contacting surface, is at least 0.05 millimeters (mm) and at most 5.0 mm.

8. The wellbore plunger of claim 1, wherein the core includes an adhesion-enhancing region configured to resist separation of the non-metallic tubing-contacting material from the core.

9. The wellbore plunger of claim 1, wherein the wellbore plunger further includes a retention structure configured to be selectively actuated between a retaining orientation, in which the retention structure operatively attaches the downhole tubing-contacting shell to the core, and a released orientation, in which the retention structure permits separation of the downhole tubing-contacting shell from the core.

10. The wellbore plunger of claim 1, wherein an entirety of the wellbore plunger is defined by the non-metallic tubing-contacting material.

11. The wellbore plunger of claim 1, wherein the non-metallic tubing-contacting material includes at least one of:
(i) a polymer;
(ii) a phenolic resin;
(iii) an epoxy;
(iv) a polyether ether ketone; and
(v) a polyphenylene sulfide.

12. The wellbore plunger of claim 1, wherein the non-metallic tubing-contacting material is at least one of:
(i) at least substantially continuous across the downhole tubing-contacting surface; and
(ii) at least substantially continuous between the uphole region and the downhole region.

13. The wellbore plunger of claim 1, wherein the non-metallic tubing-contacting material is selected to wear at least 5 times more quickly than the non-metallic tubing material during sliding contact between the downhole tubing-contacting surface and the non-metallic tubing surface.

14. The wellbore plunger of claim 1, wherein the non-metallic tubing material defines a non-metallic tubing material hardness that is at least two times a non-metallic tubing-contacting material hardness of the non-metallic tubing-contacting material.

15. The wellbore plunger of claim 1, wherein, during sliding contact between the wellbore plunger and the non-metallic tubing surface, the non-metallic tubing-contacting material is configured to be deposited on the non-metallic tubing surface to reinforce the non-metallic tubing surface.

16. The wellbore plunger of claim 1, wherein the wellbore plunger further includes a detection structure configured to detect at least one property of the downhole tubing during sliding contact between the wellbore plunger and the non-metallic tubing surface.

17. The wellbore plunger of claim 16, wherein the detection structure includes a casing collar locator configured to detect casing collars of the downhole tubing.

18. The wellbore plunger of claim 16, wherein the detection structure includes a thickness detector configured to detect at least one of:
(i) a thickness of the downhole tubing; and
(ii) a thickness of a non-metallic tubing coating that defines the non-metallic tubing surface.

19. The wellbore plunger of claim 16, wherein the detection structure includes a residue detector configured to detect buildup of residue on the non-metallic tubing surface.

20. The wellbore plunger of claim 1, wherein the wellbore plunger further includes a stored fluid reservoir configured to store, and to selectively release, a stored fluid.

21. The wellbore plunger of claim 20, wherein the stored fluid includes a patching agent configured to reinforce the non-metallic tubing material.

22. The wellbore plunger of claim 20, wherein the stored fluid includes at least one of:
(i) a residue-removing material configured to remove residue from the non-metallic tubing surface;
(ii) a scale inhibitor configured to inhibit scale formation on the non-metallic tubing surface;
(iii) a corrosion inhibitor configured to inhibit corrosion of a metallic tubular that supports the non-metallic tubing surface;
(iv) an asphaltenes inhibitor configured to inhibit asphaltenes deposition on the non-metallic tubing surface; and
(v) a paraffin inhibitor configured to inhibit paraffin deposition on the non-metallic tubing surface.

23. A well, comprising:
a wellbore extending within a subterranean formation;
downhole tubing extending within the wellbore, wherein the downhole tubing includes a non-metallic tubing material that defines a non-metallic tubing surface that at least partially defines a tubing conduit;
a bottom bumper positioned proximate a downhole end of the tubing conduit; and
the wellbore plunger of claim 1, wherein the wellbore plunger is positioned within the tubing conduit.

* * * * *